United States Patent [19]

Shirinian

[11] Patent Number: 4,845,784

[45] Date of Patent: Jul. 11, 1989

[54] GARMENT POCKET

[76] Inventor: John J. Shirinian, 1201 Woodside, Placentia, Calif. 92670

[21] Appl. No.: 296,384

[22] Filed: Jan. 9, 1989

Related U.S. Application Data

[63] Continuation of Ser. No. 48,738, May 11, 1987, abandoned.

[51] Int. Cl.[4] ..... A41D 27/20

[52] U.S. Cl. ..... 2/253

[58] Field of Search ..... 2/247, 253, 254

[56] References Cited

U.S. PATENT DOCUMENTS

| | | | |
|---|---|---|---|
| 250,228 | 11/1881 | Goldberger | 2/253 |
| 437,903 | 10/1890 | Jacobs . | |
| 648,698 | 5/1900 | Levi . | |
| 1,018,912 | 2/1912 | Kaschewski | 2/253 |
| 1,308,999 | 6/1919 | Sturdy | 2/253 |
| 1,397,729 | 11/1921 | Franklin | 2/253 |
| 1,409,809 | 3/1922 | Zendt et al. | 2/253 |
| 2,252,519 | 8/1941 | Ottusch | 2/237 |
| 2,359,012 | 9/1944 | Sophier | 2/247 |
| 2,725,573 | 9/1954 | Kornhauser | 2/247 |
| 3,137,862 | 6/1964 | Mizerak | 2/224 |
| 4,069,514 | 1/1978 | Palmieri | 2/235 |
| 4,139,914 | 2/1979 | Tarr | 2/247 |

*Primary Examiner*—Henry S. Jaudon

*Attorney, Agent, or Firm*—Stetina and Brunda

[57] ABSTRACT

A pocket structure for a fabric garment includes a first pocket having first and second opposed walls of fabric attached to one another to form a first garment pocket space between them. The first pocket is attached to hang on the inner side of the garment. A second pocket includes a third wall of fabric securely attached to the garment pocket second wall along its edges, so as to be outside the first garment pocket space, and so the third fabric wall opposes the second garment pocket fabric wall and forms a second pocket space between the second and third walls. The second pocket space is accessible only from the interior of the garment, while the first pocket space may be accessible from the outer side of the garment through a garment pocket opening. The three walls of fabric may be securely attached to and depend from, the garment, such as the waistband of a pair of slacks.

9 Claims, 1 Drawing Sheet

GARMENT POCKET

This is a continuation of copending application Ser. No. 048,788 filed on May 11, 1987.

BACKGROUND OF THE INVENTION

The present invention relates to garment pockets, and is particularly applicable to pockets for trousers or slacks. The garment pocket of the invention provides security for valuables and is hidden from view when the garment is worn, yet is easy to use, and easy to manufacture and include in the garment.

Pockets have been included in garments for numerous years to carry miscellaneous articles, such as coins, keys, passports, billfolds or wallets, paper currency, and other material. The articles carried in pockets range from those with negligible value to those having extremely high value, such as passports, credit cards, and currency.

Because many people carry articles of substantial value in their pockets, a need has existed and been recognized for a pocket or other receptacle that provides a measure of seucrity against pickpockets and other dangers to the loss of the pocket contents.

A number of potential answers to this need have been proposed over many years. Nevertheless, each has had one or more significant drawbacks. Among the common disadvantages of current solutions are limited pocket capacity, difficulty of use, bulkiness, interference with the fit or appearance of the garment, and difficulty or expense of manufacture.

One of the most common solutions to the security issue is the money belt, in which a pocket is provided inside the belt used with the trousers. The pocket is typically closed with a zipper. The money belt pocket is limited in size and capacity by the width of the belt. Often, even an article as small as a bill of currency must be carefully folded many times to fit in the pocket. An article as large as a passport or a book of travellers' checks cannot be accomodated.

Various types of pockets incorporated into the garment have been suggested, but without complete success. Generally these pockets are integrated into the design of the garment, and require that the garment be specially designed to accomodate the pocket. Such designs may make proper fitting of the garment difficult. In addition, the pocket may add considerable bulk in the garment, causing the garment to hang poorly on the wearer, and perhaps draw attention to the "hidden" valuable. Furthermore, these special constructions substantially complicate the manufacture of the garment, increasing the cost thereof to the consumer.

Accordingly, a need has been noted for a garment pocket that protects the pocket contents against pickpockets and other hazards, yet has a large capacity, is not bulky, does not require a special design to the garment, and is easy and inexpensive to manufacture.

SUMMARY OF THE INVENTION

The present invention is a pocket structure for a garment, in which the garment is made of fabric and has an inner side and an outer side. The pocket structure includes a first pocket including first and second opposed walls of fabric attached to one another to form a first pocket space between them. That first pocket is attached to the garment so that it hangs on the inner side of the garment. A second pocket includes a third wall of fabric securely attached to the second wall of fabric along its edges, so as to be outside of the first pocket space and so the third fabric wall opposes the second wall and forms a second space between the second wall and the third wall.

The pocket of the invention is for a garment having an inner side and an outer side, made of fabric having a first opening therethrough. The pocket structure of the invention includes a first pocket enclosing a first pocket space and attached to the inner side of the garment adjacent the first opening so as to permit access through the opening into the first pocket space from the outer side of the garment. The pocket structure also includes a second pocket, affixed to the first pocket outside of the first pocket space. The second pocket encloses a second pocket space and provides a second opening into the second pocket space from the inner side of the garment.

The pocket structure of the invention provides, in addition to a substantially conventional pocket having external access, a security pocket on the interior of the garment having access only from the interior of the garment, without adding substantial bulk to the garment, as the pocket structure of the invention includes primarily only three layers of fabric or cloth to provide both pockets, and the pocket structure is integrated into the garment.

BRIEF DESCRIPTION OF THE DRAWINGS

FIG. 4 shows an alternate embodiment of the pocket structure of the invention.

DETAILED DESCRIPTION OF THE PREFERRED EMBODIMENTS

The pocket structure of the present invention is described herein in the context of a hip pocket for trousers or slacks, although those skilled in the art will recognize that the invention may also be used in numerous other garments and for other pockets on slacks.

Figure 1:
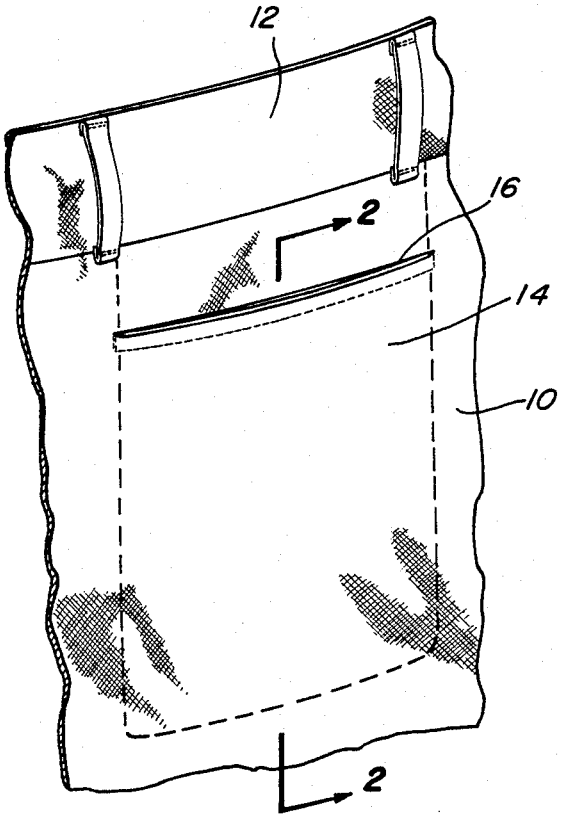
FIG. 1 is a perspective view showing the outer side of a pair of slacks including a pocket structure constructed according to the invention, with the pocket on the inside of the garment illustrated with phantom lines.

Referring first to FIG. 1, the outer side of the rear side (hip) portion of a pair of trousers or slacks is shown. the slacks include a body 10 made of a flexible material, typically fabric. A waistband 12 of substantially conventional construction is included at the top of the garment. Depending or hanging from the waistband is a pocket structure 14 constructed according to the invention. In conventional fashion, a pocket opening 16 through the garment fabric provides access to the pocket, as is described herein.

Figure 2:
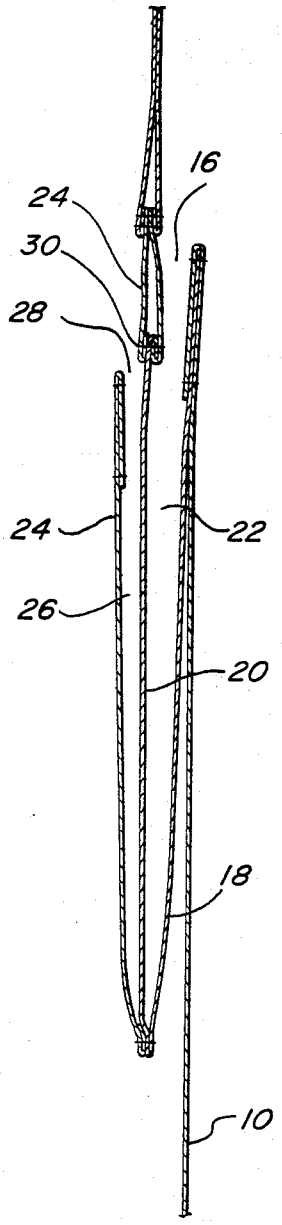
FIG. 2 is a cross sectional view taken along line 2—2 of the pocket structure shown in FIG. 1.
Figure 3:
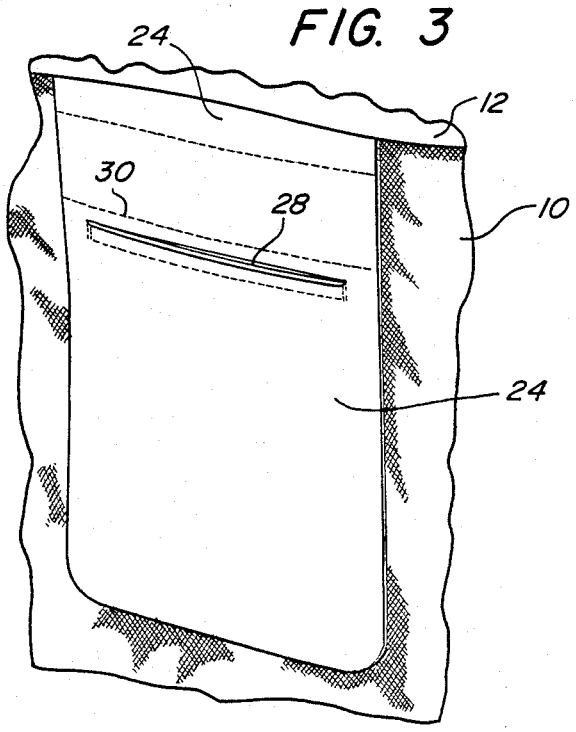
FIG. 3 is an elevation view showing the interior surface of the pocket structure included in the garment shown in FIG. 1.

Referring to the cross-section shown in FIG. 2, the pocket structure includes a first pocket that is formed of two opposed walls 18, 20 of fabric attached to each other along their edges to form a pocket space 22 between them. As is typical, the pocket hangs on the inner side of the garment, adjacent the inner side of the garment fabric 10. The first pocket wall 18 may be adjacent and opposed to the inner side of the garment fabric. The first wall 18 may then be referred to as the "outer"

pocket wall and the second wall 20 may be referred to as the "inner" pocket wall.

The first pocket may be constructed in a conventional, known manner. The second wall 20 may extend up to, and be securely attached to the garment waistband. The first wall 18 may be slightly shorter than the second wall 20 so as to not extend into the waistband. An opening through the first wall 18 coincides with the pocket opening 16 through the garment fabric 10. The edges of that pocket wall opening are securely attached to the garment fabric opening 16, with the garment fabric 10 preferably overlapping the pocket wall opening to provide a smooth appearance and added strength. The fabric opening 16 and the pocket wall opening provide conventional access from the outside of the garment into the first pocket space between the first and second pocket walls 18, 20.

The first and second pocket walls 18, 20 may have essentially the same shape below the pocket opening 16. For the trousers hip pocket shown, the distance from the pocket opening 16 to the bottom of the first pocket space 22 may be approximately $6\frac{1}{2}$ to $7\frac{1}{2}$ inches. The second wall 20 may have a total length of approximately eleven inches to provide a sufficient amount to sew into the waistband 12. The first wall 18 may be $6\frac{3}{4}$ to $7\frac{3}{4}$ inches to extend just above the pocket opening 16. The top edge of the first wall 18 may or may not be attached to the second wall 20. The first and second walls are preferably slightly wider than the pocket opening 16 so that the garment fabric 10 can be stitched to the first pocket wall 18 all around the fabric pocket opening 16.

For certain pockets, the first and second walls 18, 20 may be formed of a single piece of fabric folded approximately in half and stitched along its free edges, rather than two separate pieces of fabric.

According to the invention, a second pocket is attached to the first pocket, outside of the first pocket space 22. The second pocket is formed by attaching a third wall of flexible material 24, such as fabric, to the second fabric wall 20 of the first pocket. The third wall of fabric 24 is attached to the second wall 20 along the edges of the third wall, to oppose the second wall and form a second pocket space 26 between the second and third walls 20, 24. The third wall 24 is attached to the second wall outside the first pocket space 22.

The bottom and side edges of the third pocket wall 24 are attached to the edges of the second wall 20. The third wall may therefore have substantially the same shape and dimensions as the first and second wall 18, 20. The top edge of the third wall may be attached with the top edge of the second pocket wall to the garment waistband, or may be securely attached to the second pocket wall below the waistband. Thus the entire pocket structure hangs from the garment waistband 12, by having the top edge of at least one of the first, second, or third pocket walls 18, 20, 24 attached to the waistband 12.

An opening 28 through the third wall 24 provides access into the second pocket space 26 from the inner side of the garment. The fabric of the third wall may be reinforced around the edges of the opening 28, to prevent tearing of the third wall. The third wall is preferably slightly wider than the second pocket opening 28. The edge of the third wall that forms the top edge of the second pocket opening 28 may also be double-layered for reinforcement. The ends of the opening 28 may be strengthened by stitching to minimize tearing. The third wall 24 may be further attached to the second wall 20 by stitching 30 just above the second pocket opening.

The opening 28 into the second pocket space 26 is accessible only from the inner side of the garment, and is not directly accessible from the outer side of the garment. For example, in the embodiment shown, if the wearer needs to access the second pocket space, he would reach inside the waistband to the interior of the garment to reach the opening into the second pocket. The second pocket opening 28 is positioned so as to not be accessible from or through the outer pocket opening 16. No direct communication is provided between the first pocket space 22 and the second pocket space 26. Such an arrangement essentially eliminates the possibility of a pickpocket gaining unauthorized access to the second pocket space 26 and its contents.

Alternatively, the third fabric wall 24 may have a length somewhat less than the second wall 20, so that the bottom and side edges of the third wall 24 coincide with the bottom and side edges of the second wall 20, but the top edge of the third wall is somewhat lower than the waistband. The top edge of the third wall is not attached to the second wall, or to the garment waistband, to provide the access opening 28 into the second pocket space 26 between the second and third pocket walls.

The garment pocket structure described and shown is readily constructed and installed in conventional garments. No special waistband or major special garment structure needs to be constructed. In addition, the pocket structure may, in some garments, be added to the existing structure by adding the third wall of fabric material to the inner wall of an existing garment pocket, external to the existing pocket space, so that the new piece of fabric provides a second pocket space. The added piece of fabric may be substantially the same size and shape as the existing pocket walls, or it may have substantially the same width, but have a length up to about one and one-half inches less than the length of the existing pocket. Either the top of the added piece of fabric is not attached to the existing pocket, or an opening is provided through the added piece of fabric for access from the interior of the garment into the second pocket space.

The opening 28 for the second pocket may be secured with a closure or fastener to further reduce the possibility of unauthorized access to the pocket and its contents. The closure may include a zipper 29 across the second pocket opening 28, as shown in FIG. 4. Other types of closures include snaps, buttons, or hook-and-loop (such as Velcro TM) fasteners.

The fastener may connect the two portions of the third wall 24 above and below the opening 28 together, or a flap of fabric may be attached to and extend from the upper portion of the third wall, over the opening 28, and fasten by an attachment to the outer side of the lower portion of the third wall 24.

The entire pocket structure thus has a thickness of only three thicknesses of pocket fabric, plus minor reinforcements around the pocket openings. The existence of the pocket is undetectable from the exterior of the garment.

The pocket structure may easily be incorporated into essentially conventional garments, such as slacks, without structural modification of the garment. The pocket structure is thus easy and inexpensive to include in a garment.

As noted previously, although the garment pocket structure of the invention has been described by reference to embodiments intended for use with men's trousers, those skilled in the art will recognize that the pocket may also be used in coats, ladies' slacks, and other garments.

Numerous modifications to the structure of the embodiments described above will be obvious to those skilled in the art without departing from the essence of the invention. Therefore, the invention is not limited by the drawings and the detailed descriptions provided above, but rather is defined by the following claims.

I claim:

1. A pocket structure for a garment, said garment comprising fabric and having an inner side and an outer side, said pocket structure comprising:

a first pocket comprising first and second opposed walls of fabric attached to one another to form a first space therebetween, wherein said first and second walls are attached to said garment so that said first pocket hangs on the inner side of said garment; and a second pocket comprising a third wall of fabric having at least one upper edge and two side edges, said third wall being permanently attached to said second wall along the edges thereof, outside of said first space to oppose said second wall and form a second space between said second wall and said third wall said third wall having a slit-like opening formed therethrough, beneath the upper edge thereof, and generally running from side to side between said side edges, said slit-like opening being sized and configured to provide access to said second space.

2. The pocket structure of claim 1, wherein said first wall of said first pocket faces the fabric of said garment.

3. The pocket structure of claim 2, wherein said third wall is substantially the same size and shape as said first and second walls.

4. The pocket structure of claim 1, additionally comprising a closure for securing said slit like opening.

5. A pocket structure for a garment, wherein said garment has an inner side and an outer side and comprises fabric having a pocket opening therethrough, said pocket structure comprising:

a first pocket comprising first and second opposed walls of fabric forming therebetween a first space, wherein said first and second walls are attached to said garment around said pocket opening so that said first pocket hangs on the inner side of said garment, and said pocket opening provides access from the outer side of said garment into said first space; and a second pocket comprising a third wall of fabric having at least an upper edge and two side edges, securely attached to said second wall opposite said first wall, so as to oppose said second wall and form a second space between said second wall and said third wall, said third wallhaving a slit-like opening extending therethrough into said second space from the inner side of the garment, said slit-like opening extending generally from side to side between said side edges and said slit-like opening being located below the said upper edge of the third wall of fabric.

6. The pocket structure of claim 5 wherein a plurality of edges of each of said first, second, and third walls are securely attached to each other.

7. A pocket structure for a garment, wherein said garment has an inner side and an outer side, and comprises fabric having a first opening therethrough, said pocket structure comprising:

a first pocket enclosing a first pocket space and attached to the inner side of said garment adjacent said first opening so as to permit access through said opening into said first pocket space from the outer side of said garment; and a second pocket, affixed to said first pocket outside of said first pocket space, said second pocket enclosing a second pocket space and said second pocket space being defined at least in part by an inner fabric wallhaving at least an upper edge and two side edges, said inner fabric wall being attached to the first pocket and said inner fabric wall having a slit-like opening formed therethrough, beneath the upper edge thereof and generally running from side to side between said side edges, to provide access to said second pocket space.

8. The pocket structure of claim 7, wherein no direct communication is provided between said first pocket space and said second pocket space.

9. A hip pocket structure for a pair of slacks, comprising:

a hip pocket of conventional construction comprising first and second fabric walls securely attached to the slacks fabric, and to each other to form a first pocket space therebetween; and a third fabric wallhaving a periphery consisting of an upper edge, a lower edge and two side edges, said third fabric wall being attached to one of said first or second walls, outside of said first pocket space so as to form a second pocket space; and said third fabric wall having a slit like opening formed therethrough, said slit like opening being positioned generally between said side edges and beneath said upper edge to provide access to said second pocket space and;

said third fabric wall being affixed to said second fabric wall at least at one paint above said slit opening.

* * * * *